US006818077B2

(12) United States Patent
Yoshinari et al.

(10) Patent No.: US 6,818,077 B2
(45) Date of Patent: Nov. 16, 2004

(54) HIGH-STRENGTH NI-BASE SUPERALLOY AND GAS TURBINE BLADES

(75) Inventors: Akira Yoshinari, Hitachinaka (JP); Hideki Tamaki, Hitachi (JP); Hiroyuki Doi, Naka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/429,801

(22) Filed: May 6, 2003

(65) Prior Publication Data

US 2004/0177901 A1 Sep. 16, 2004

(30) Foreign Application Priority Data

Dec. 17, 2002 (JP) ..... 2002-364541

(51) Int. Cl.[7] ..... C22C 19/05

(52) U.S. Cl. ..... 148/428; 420/445; 420/446; 420/447; 420/448; 420/449; 420/450; 420/451; 420/452; 420/453; 420/454

(58) Field of Search ..... 148/428; 420/445–454

(56) References Cited

U.S. PATENT DOCUMENTS

| | | | | |
|---|---|---|---|---|
| 3,615,376 A | | 10/1971 | Ross | |
| 3,677,331 A | * | 7/1972 | Lund et al. | 164/122 |
| 4,140,555 A | * | 2/1979 | Garcia et al. | 148/428 |
| 4,719,080 A | * | 1/1988 | Duhl et al. | 420/443 |
| 4,983,233 A | * | 1/1991 | Henry | 148/428 |
| 5,328,659 A | * | 7/1994 | Tillman et al. | 420/448 |
| 5,431,750 A | | 7/1995 | Kawai et al. | |
| 5,516,381 A | * | 5/1996 | Kawai et al. | 148/410 |
| 6,322,643 B1 | | 11/2001 | Mitsuhashi et al. | |
| 6,416,596 B1 | | 7/2002 | Wood et al. | |
| 6,428,637 B1 | | 8/2002 | Wood et al. | |
| 2002/0157538 A1 | * | 10/2002 | Foglietta et al. | 95/237 |
| 2002/0195175 A1 | * | 12/2002 | Ishida et al. | 148/427 |
| 2003/0103862 A1 | * | 6/2003 | Bouse et al. | 420/448 |

FOREIGN PATENT DOCUMENTS

| | | |
|---|---|---|
| CH | 501 058 | 12/1970 |
| EP | 0 361 084 | 4/1990 |
| EP | 0 937 764 A1 | 8/1999 |
| JP | 6-57359 | 3/1994 |
| WO | WO 99/67435 | 12/1999 |

OTHER PUBLICATIONS

N.S. Cheruvu, "Development of Corrosion Resistant Directionally Solidified Material for Land Based Turbine Blades", Transaction of the ASME, vol. 120, No. 4, Oct. 1998, pp. 744–750, XP009026878 (with Abstract XP 002272169).

J.M. N'Gandu Muamba et al., "L'Influence du Hafnium du Substrat sur la Resistance a l'Oxydation des Revetements d'Aluminiures sur les Superalliages Base Nickel", XP 009026879 (with English Abstract XP 002272170). XP002272168.

* cited by examiner

*Primary Examiner*—John P Sheehan
(74) *Attorney, Agent, or Firm*—McDermott, Will & Emery LLP

(57) ABSTRACT

A nickel-based superalloy containing 12.0 to 16.0% by weight of Cr, 4.0 to 9.0% by weight of Co, 3.4 to 4.6% by weight of Al, 0.5 to 1.6% by weight of Nb, 0.05 to 0.16% by weight of C, 0.005 to 0.025% by weight of B, and at least one of Ti, Ta and Mo. Amounts of Ti, Ta and Mo are ones calculated by the equations (1) and (2), wherein TiEq is 4.0 to 6.0 and MoEq is 5.0 to 8.0.

$$TiEq = Ti\ \%\ by\ weight + 0.5153 \times Nb\ \%\ by\ weight + 0.2647 \times Ta\ \%\ by\ weight \quad (1)$$

$$MoEq = Mo\ \%\ by\ weight + 0.5217 \times W\ \%\ by\ weight + 0.5303 \times Ta\ \%\ by\ weight + 1.0326 \times Nb\ \%\ by\ weight \quad (2)$$

17 Claims, 7 Drawing Sheets

HIGH-STRENGTH NI-BASE SUPERALLOY AND GAS TURBINE BLADES

FIELD OF THE INVENTION

The present invention relates to a Ni-base superalloy and a gas turbine blade made of cast Ni-base superalloy.

DESCRIPTION OF PRIOR ART

In power engines such as jet engines, land-based gas turbines, etc., turbine inlet temperatures are being elevated more and more so as to increase efficiency of the turbines. Therefore, it is one of the most important objects to develop turbine blades material that withstands high temperatures.

The main properties required for turbine blades are high creep rupture strength, high ductility, superior resistance to oxidation in high temperature combustion gas atmosphere and high corrosion resistance. In order to satisfy these properties, nickel base superalloys are used as turbine blade materials at present.

There are conventional cast alloys, unidirectional solidification alloys of columnar grains and single crystal nickel base alloys as nickel base superalloys. Among these, conventional cast alloys have the highest casting yield of the blades. Thus, the technique is appropriate for manufacturing land-based gas turbine blades. See Japanese Patent Laid-open Hei 6 (1994)-57359. However, the normal cast steel is still insufficient in its high temperature creep rupture strength. Thus, there have not been proposed alloys that have high temperature creep rupture strength, corrosion resistance and oxidation resistance.

There are single crystal alloys or unidirectional solidification alloys that have superior creep rupture strength, but these alloys contain a smaller chromium content and contain larger amounts of tungsten and tantalum which have high solid solution strengthening so as to improve creep rupture strength. Therefore, these alloys are insufficient in corrosion resistance at high temperatures. From the viewpoint of corrosion resistance, these alloys that contain relatively large amount of impurities are not suitable for land based gas turbines.

An object of the present invention is to provide a nickel base superalloy for normal casting or unidirectional casting, which has improved high temperature creep rupture strength, oxidation resistance and corrosion resistance, and also provide a gas turbine blade made of the alloy.

DESCRIPTION OF THE INVENTION

Figure 1:
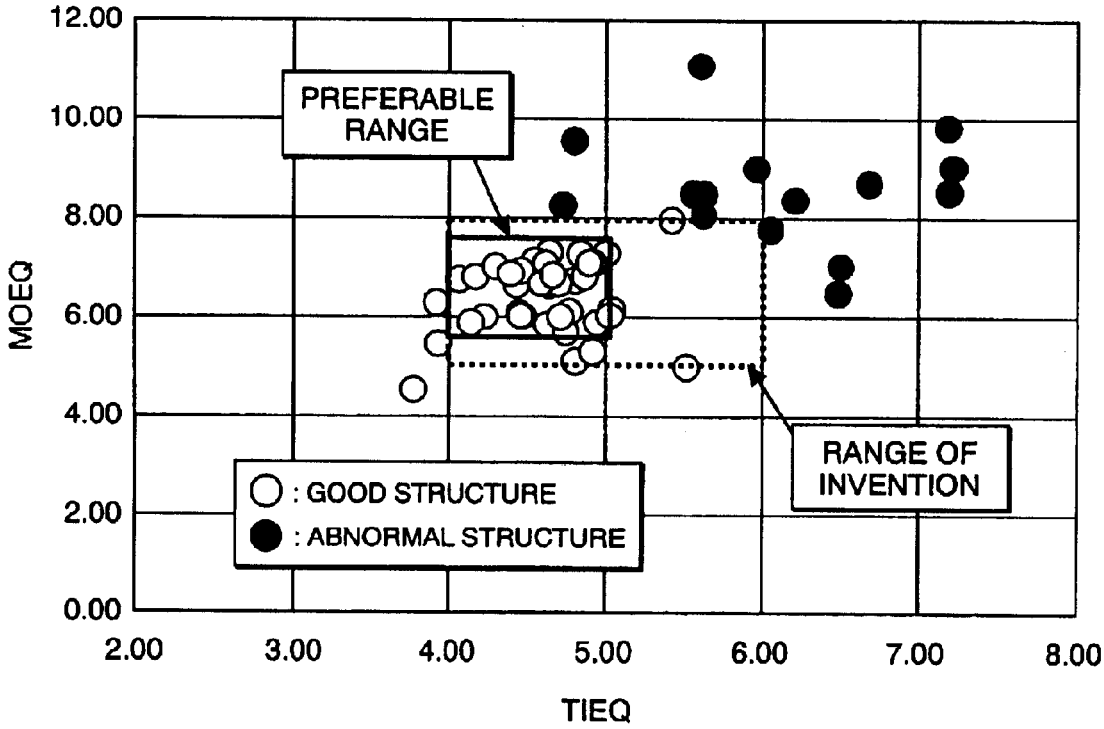
FIG. 1 shows relationship between MoEq and TiEq values.

The nickel base superalloy of the present invention contains, 12.0 to 16.0% by weight of Cr, 4.0 to 9.0% by weight of Co, 3.4 to 4.6% by weight of Al, 0.5 to 1.6% by weight of Nb, 0.05 to 0.16% by weight of C, 0.005 to 0.025% by weight of B, and Ti, Ta, Mo and W.

In addition to the above ingredients, there are contained, 0 to 2.0% by weight of Hf, 0 to 0.5% by weight of Re, 0 to 0.05% by weight of Zr, 0 to 0.005% by weight of O, 0 to 0.005% by weight of N, 0 to 0.01% by weight of Si, 0 to 0.2% by weight of Mn, 0 to 0.01% by weight of P, and 0 to 0.01% by weight of S.

The remaining is substantially nickel and unavoidable impurities that may be introduced at the time of making the alloy.

The nickel base alloy of the present invention has a composition calculated by the following equations.

$$\text{TiEq}=\text{Ti \% by weight}+0.5153\times\text{Nb \% by weight}+0.2647\times\text{Ta \% by weight}$$

$$\text{MoEq}=\text{Mo \% by weight}+0.5217\times\text{W \% by weight}+0.5303\times\text{Ta \% by weight}+1.0326\times\text{Nb \% by weight}$$

The nickel base alloy of the present invention has a structure wherein γ' phase precipitates in austenite matrix. The γ' phase is an intermetallic compound, which may be Ni3(Al,Ti), Ni3(Al,Nb), Ni3(Al,Ta,Ti), etc, based on alloy compositions.

TiEq that relates to stability of matrix and creep rupture strength is a sum of Ti numbers that are calculated by summing [Ti] % by weight, Ti equivalent of [Nb] % by weight and Ti equivalent of [Ta] % by weight. In order to precipitate γ' phase in γ phase matrix, in other words, in order to prevent precipitation of brittle phases such as TCP phase, σ phase or η phase, TiEq value should be 6.0 or less. The smaller the TiEq, the better the stability of matrix becomes. But, if TiEq is too small, the creep rupture strength will be lower. Thus, TiEq should be 4.0 or more. More preferably, TiEq should be within a range of from 4.0 to 5.0 so that particularly high creep rupture strength is expected.

MoEq that also relates to stability of matrix and creep rupture strength is a sum of Mo numbers that are calculated by summing [Mo] % by weight, Mo equivalent of [W] % by weight, Mo equivalent of [Ta] % by weight, and Mo equivalent of [Nb] % by weight. In order to stabilize matrix, MoEq should be 8.0 or less. The smaller the MoEq, the better the stability of matrix becomes. But, if MoEq is too small, creep rupture strength will be lower. Thus, MoEq should be 5.0 or more. More preferably, 5.5 to 7.5 of MoEq should be selected.

In the nickel base alloy of the invention, a preferable range of W is 3.5 to 4.5% by weight, Mo is 1.5 to 2.5% by weight, Ta is 2.0 to 3.4% by weight and Ti is 3.0 to 4.0% by weight. Accordingly, the present invention provides nickel base heat resisting alloys that contain the above elements in the specified ranges.

In the following, functions and reasons of contents will be explained.

Cr; 12.0 to 16.0% by weight: Cr is effective to improve corrosion resistance at high temperatures, and is truly effective at an amount of 12.0% by weight or more. Since the alloy of the invention contains Co, Mo, W, Ta, etc, an excess amount of Cr may precipitate brittle TCP phase to lower high temperature strength. Thus, the maximum amount of Cr is 16.0% by weight to take balance between the properties and ingredients. In this composition, superior high temperature strength and corrosion resistance are attained.

Co; 4.0 to 9.0% by weight

Co makes easy solid solution treatment by lowering precipitation temperature of γ' phase, and strengthen γ' phase by solid solution and improve high temperature corrosion resistance. These improvements are found when the amount of cobalt is 4.0% by weight or more. If Co exceeds 9.0% by weight, the alloy of the invention loses balance between the ingredients and properties because W, Mo Co, Ta, etc are added, thereby to suppress the precipitation of γ' phase to lower high temperature strength. Therefore, the upper limit of Co should be 9.0% by weight. In considering balance between easiness of solid solution heat treatment and strength, a preferable range is within 6.0 to 8.0% by weight.

W; 3.5 to 4.5% by weight

W dissolves in γ phase and precipitated γ' phase as solid solution to increase creep rupture strength by solid solution strengthening. In order to attain these advantages, W is necessary to be 3.5% by weight or more. Since W has large density, it increases specific gravity (density) of alloy and decreases corrosion at high temperatures. When W amount exceeds 4.5% by weight, needle-like W precipitates to lower creep rupture strength, corrosion at high temperatures and toughness. In considering the balance between high temperature strength, corrosion resistance and stability of structure matrix at high temperatures, a preferable range of W is 3.8 to 4.4% by weight.

Mo; 1.5 to 2.5% by weight

Mo has the similar function to that of W, which elevates solid solubility temperature of γ' phase to improve creep rupture strength. In order to attain the function, at least 1.5% by weight of Mo is necessary. Since Mo has smaller density than W, it is possible to lessen specific gravity (density) of alloy. On the other hand, Mo lowers oxidation resistance and corrosion resistance, the upper limit of Mo is 2.5% by weight. In considering balance between strength, corrosion resistance and oxidation resistance at high temperatures, a preferable range of Mo is 1.6 to 2.3% by weight.

Ta; 2.0 to 3.4% by weight

Ta dissolves in γ' phase in the form of Ni3(Al,Ta) to solid-strengthen the alloy, thereby increasing creep rupture strength. In order to attain this effect, at least 2.0% by weight of Ta is preferable. On the other hand, if Ta exceeds 3.4% by weight, it becomes supersaturated thereby to precipitate [Ni, Ta] or needle like σ phase. As a result, the alloy has lowered creep rupture strength. Therefore, the upper limit of Ta is 3.4% by weight. In considering balance between high temperature strength and stability of structure matrix, a preferable range is 2.5 to 3.2% by weight.

Ti; 3.0 to 4.0% by weight

Ti dissolves in γ' phase as Ni(Al,Ti) solid to strengthen the matrix, but it does not have good effect as Ta does. Ti has a remarkable effect to improve cession resistance at high temperatures. In order to attain high temperature corrosion resistance, at least 3% by weight is necessary. However, if Ti exceeds 4.0% by weight, oxidation resistance of alloy decreases drastically. Thus, the upper limit of Ti is 4.0% by weight. In considering balance between high temperature strength and oxidation resistance, a preferable range is 3.2 to 3.6% by weight.

Nb, 0.5 to 1.6% by weight

Nb is an element that solid-dissolves in γ' phase in the form of Ni3(Al,Nb) to strengthen the matrix, but it does not have an effect as Ta does. On the contrary, it remarkably improves corrosion resistance at high temperatures. In order to attain corrosion resistance, at least 0.5% by weight of Nb is necessary. However, if the amount exceeds 1.6% by weight, strength will decrease and oxidation resistance will be lowered. Thus, the upper limit is 1.6% by weight. In considering balance between high temperature strength, oxidation resistance and corrosion resistance, a preferable amount will be from 1.0 to 1.5% by weight.

Al; 3.4 to 4.6% by weight

Al is an element for constituting the γ' reinforcing phase, i.e. Ni3Al that improves creep rupture strength. The element also remarkably improves oxidation resistance. In order to attain the properties, at least 3.4% by weight of Al is necessary. If the amount of Al exceeds 4.6% by weight, excessive γ' phase precipitates to lower strength and degrades corrosion resistance because it forms composite oxides with Cr. Accordingly, a preferable amount of Al is 3.4 to 4.6% by weight. In considering balance between high temperature strength and oxidation resistance, a more preferable range is 3.6 to 4.4% by weight.

C; 0.05 to 0.16% by weight

C may segregate at the grain boundaries to strengthen the grain boundaries, and at the same time a part of it forms TiC, TaC, etc. that precipitate as blocks. In order to effect segregation at grain boundaries to strengthen grain boundaries, at least 0.05% by weight of C is necessary. If an amount of C exceeds 0.16% by weight, excessive amount of carbides are formed to lower creep rupture strength and ductility at high temperatures, and corrosion resistance as well. In considering balance between strength, ductility and corrosion resistance, a more preferable range is 0.1 to 0.16% by weight.

B; 0.005 to 0.025% by weight

B segregates at grain boundaries to strengthen grain boundaries, and a part of it forms borides such as (Cr,Ni, Ti,Mo)3B2, etc. that precipitate at grain boundaries. In order to effect segregation at grain boundaries, at least 0.005% by weight is necessary. However, since the borides have remarkably low melting points that lowers a melting point of the alloy and narrower the solid-solution heat treatment temperature range, an amount of B should be no more than 0.025% by weight. In considering balance between strength and solid-solution treatment, a more preferable range of B is 0.01 to 0.02% by weight.

Hf; 0 to 2.0% by weight

This element does not serve for enhancing strength of the alloy, but it has a function to improve corrosion resistance and oxidation resistance at high temperatures. That is, it improves bonding of a protective oxide layer of Cr2O3, Al2O3, etc. by partitioning between the oxide layer and the surface of the alloy. Therefore, if corrosion resistance and oxidation resistance is desired, addition of Hf is recommended. If an amount of Hf is too large, a melting point of alloy will lower and the range of solid-solution treatment will be narrowed. The upper limit should be 2.0% by weight. In case of normal casting alloys, effect of Hf is not found in the least. Therefore, addition of Hf is not recommended. Thus, the upper limit of Hf should be 0.1% by weight. On the other hand, in unidirectional solidification casting, remarkable effect of Hf is found, and hence at least 0.7% by weight of Hf is desired.

Re; 0 to 0.5% by weight

Almost all of Re dissolves in γ phase matrix and improves creep rupture strength and corrosion resistance. However, since Re is expensive and has a large density to increase specific gravity (density) of alloy, Re is added if necessary. In the alloy of the present invention that contains a large amount of Cr, needle like α-W or α-Re precipitates when an amount of Re exceeds 0.5% by weight, to thereby lower creep rupture strength and ductility. Thus, the upper limit should be 0.5% by weight.

Zr; 0 to 0.05% by weight

Zr segregates at the grain boundaries to improve strength at the boundaries more or less. Most of Zr forms intermetallic compound with Ni to form Ni3Zr at grain boundaries.

The intermetallic compound lowers ductility of the alloy and it has a low melting point to thereby lower melting point of the alloy that leads to a narrow solid-solution treatment range. Zr has no useful effect, and the upper limit is 0.05% by weight.

O; 0 to 0.005% by weight

N; 0 to 0.005% by weight

O and N are elements mainly introduced into the alloy from raw materials in general. O may be carried in alloys in a crucible. O or N introduced into alloys are present in the crucible in the form of oxides such as $Al_2O_3$ or nitrides such as TiN or AlN. If these compounds are present in castings, they become starting points of cracks, thereby to lower creep rupture strength or to be a cause of stress-strain cracks. Particularly, O appears in the surface of castings that are surface defects to lower a yield of castings. Accordingly, O and N should be as little as possible. O and N should not exceed 0.005% by weight.

Si; 0 to 0.01% by weight

Si is introduced into casting by raw materials. In the present invention, since Si is not effective element, it should be as little as possible. Even if it is contained, the upper limit is 0.01% by weight.

Mn; 0 to 0.2% by weight

Mn is introduced into castings by raw materials, too. As same as Si, Mn is not effective in the alloys of the present invention. Therefore, it should be as a little as possible. The upper limit is 0.2% by weight.

P; 0 to 0.01% by weight

P is an impurity that should be as little as possible. The upper limit is 0.01% by weight.

S; 0 to 0.01% by weight

S is an impurity that should be as little as possible. The upper limit is 0.01% by weight.

According to the present invention, there is provided a nickel-based superalloy comprising Cr, Co, W, Mo, Ta, Ti, Al, Nb, C and B in ranges of optimum amounts. Concretely, the nickel-based supperalloy comprises 13.0 to 15.0% by weight of Cr, 6.0 to 8.0% by weight of Co, 3.8 to 4.4% by weight of W, 1.6 to 2.3% by weight of Mo, 2.3 to 3.2% by weight of Ta, 3.2 to 3.6% by weight of Ti, 3.6 to 4.4% by weight of Al, 1.0 to 1.5% by weight of Nb, 0.10 to 0.16% by weight of C and 0.01 to 0.02 4 by weight of B.

DETAILED DESCRIPTION OF PREFERRED EMBODIMENTS

Figure 6:
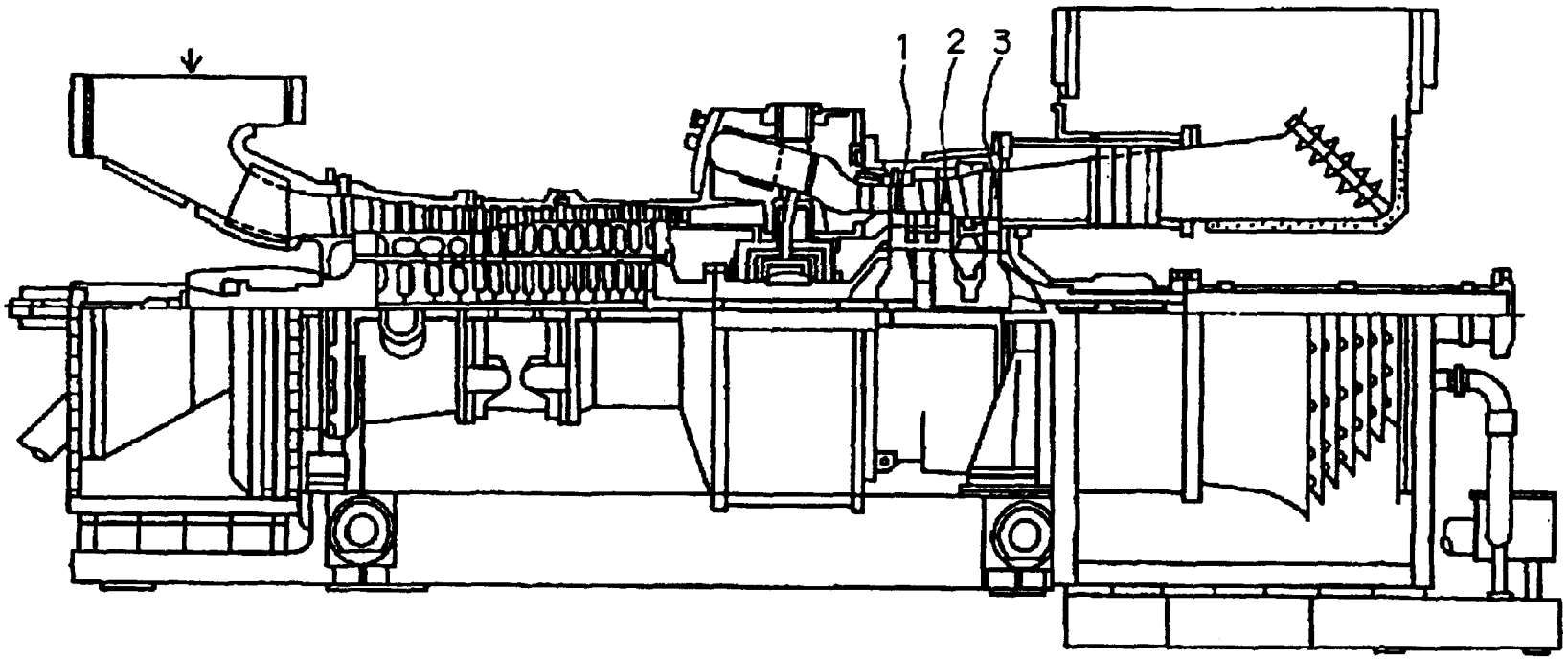
FIG. 6 is a perspective view of a gas turbine.
Figure 7:
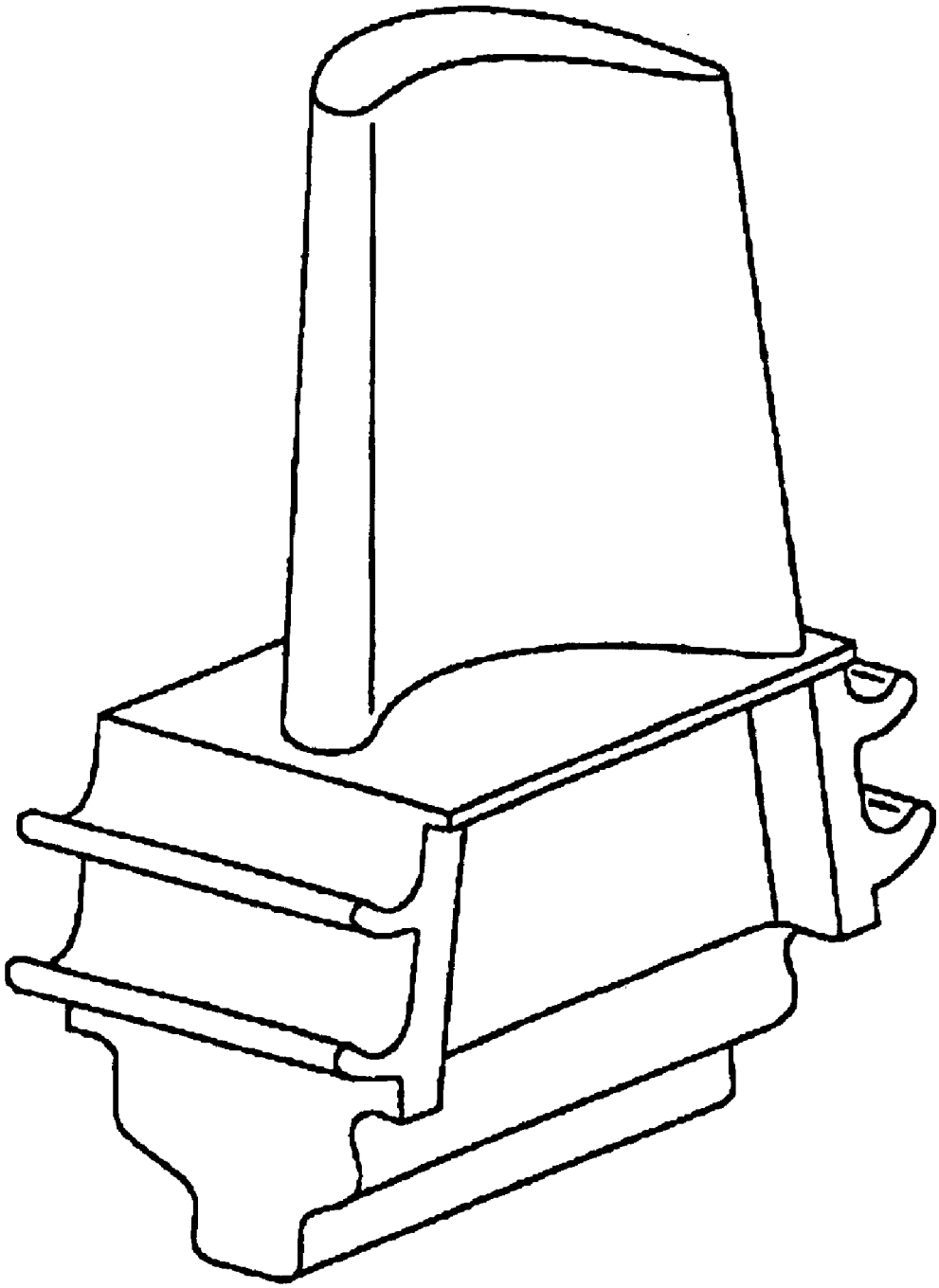
FIG. 7 is a perspective view of a gas turbine blade.

FIG. 6 shows a perspective view of a land-based gas turbine. In FIG. 6, numeral 1 denotes first stage blade, numeral 2 second stage blade and numeral 3 third stage blade. Among the blades, the first stage blade is subjected to highest temperature and the second stage blade second highest temperature. FIG. 7 shows a perspective view of a blade of a land-based gas turbine. In a normal gas turbine, the height of the blade is about ten and several centimeters. In the present invention, the turbine blade is made of a normal casting material of the nickel-based superalloy. If necessary, the blade is made by unidirectional casting alloy.

In the following, test pieces were prepared by machining out them from conventional casting.

In table 1, there are shown chemical compositions of the alloys of the present invention (A1 to A28). In table 2, there are shown chemical compositions of comparative alloys (B1 to B28) and conventional alloys (C1 to C3).

Each alloy was prepared by melting and casting using a vacuum induction furnace with a refractory crucible having a volume of 15 kg. Each ingot had a diameter of 80 mm and a length of 300 mm. Then, the ingot was vacuum melted in an alumina crucible and cast in a ceramic mold heated at 1000° C. to make a casting of a diameter of 20 mm and a length of 150 mm. After casting, solid-solution heat treatment and aging heat treatment at conditions shown in Table 3 were carried out.

Test pieces for creep rupture test each of which has a diameter of 6.0 mm in 30 mm of a gauge length, test pieces for high temperature oxidation test each having a length of 25 mm, a width of 10 mm, and a thickness of 1.5 mm, and test pieces for high temperature corrosion test each having a diameter of 8.0 mm and a length of 40.0 mm. Micro structure of each test piece was examined with a scanning type electron microscope to evaluate stability of the matrix structure.

In Table 4 there are shown test conditions done on each test piece for evaluation of properties.

Creep rupture test was conducted under the conditions of 1123K-314 MPa and 1255K-138 MPa. High temperature oxidation test was conducted under the condition of 1373K, which was repeated 12 times after holding test pieces for 20 hours. High temperature corrosion test was conducted under the condition where the test piece was exposed to combustion gas containing 80 ppm of NaCl and the corrosion test under the condition 1173K was repeated 10 times in 7 hours to measure weight change.

In Table 5 there are shown TiEq and MoEq values and stability of structure matrix of alloys of the present invention. FIG. 1 shows relationship between TiEq values and MoEq values with respect to alloys (A1 to A28) of the present invention.

In Table 5 and FIG. 1, represents alloys whose abnormal structure matrix was observed and ○ represents alloys whose abnormality was not observed. The abnormal structure matrix is that TCP phase or nphase when structure observation was made after heat treatment. As is apparent from FIG. 1, when TiEq and MoEq values are chosen to be in the ranges of the present invention, alloys with superior in structure matrix are obtained.

Figure 2:
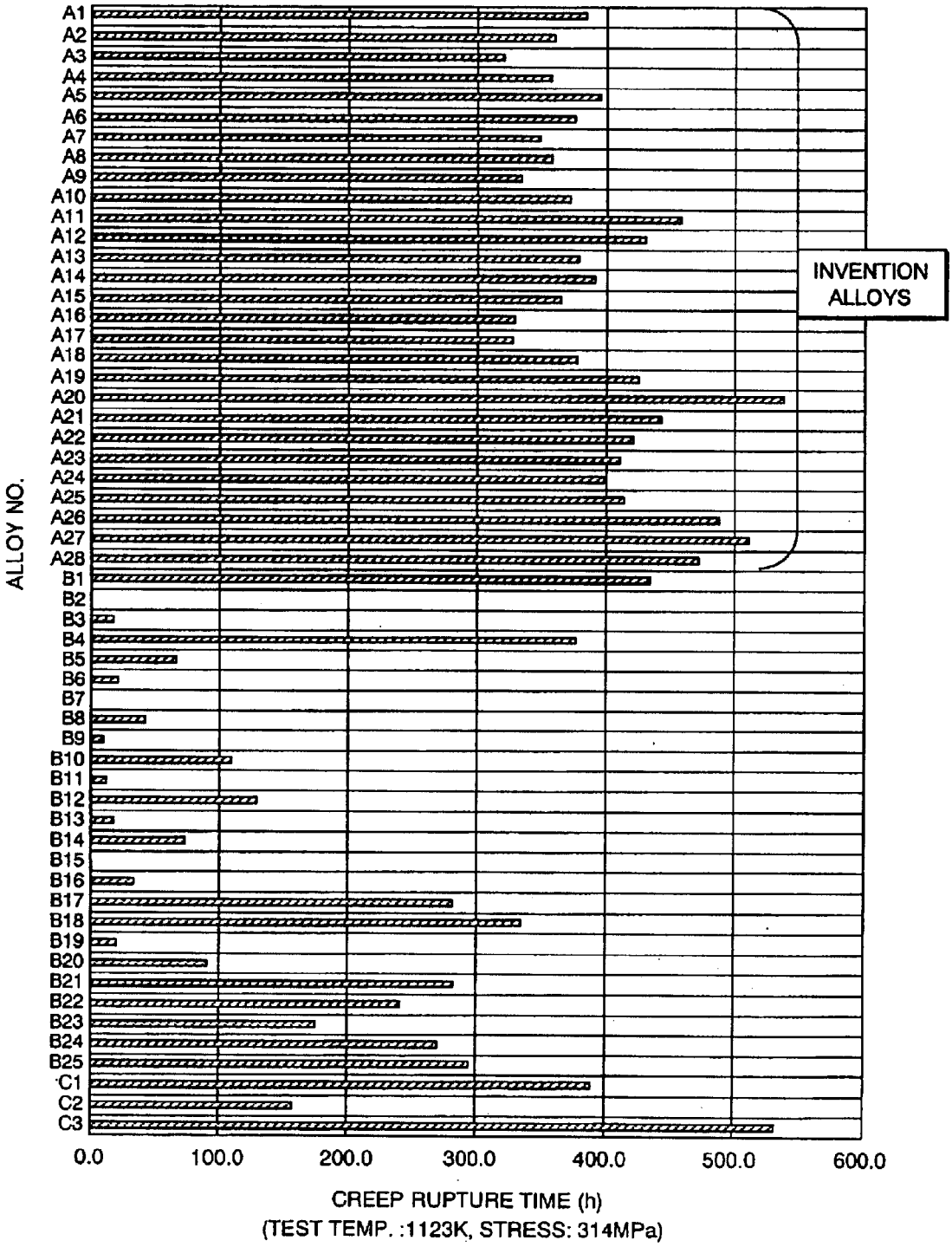
FIG. 2 is a bar graph showing creep rupture time in creep rupture tests.
Figure 3:
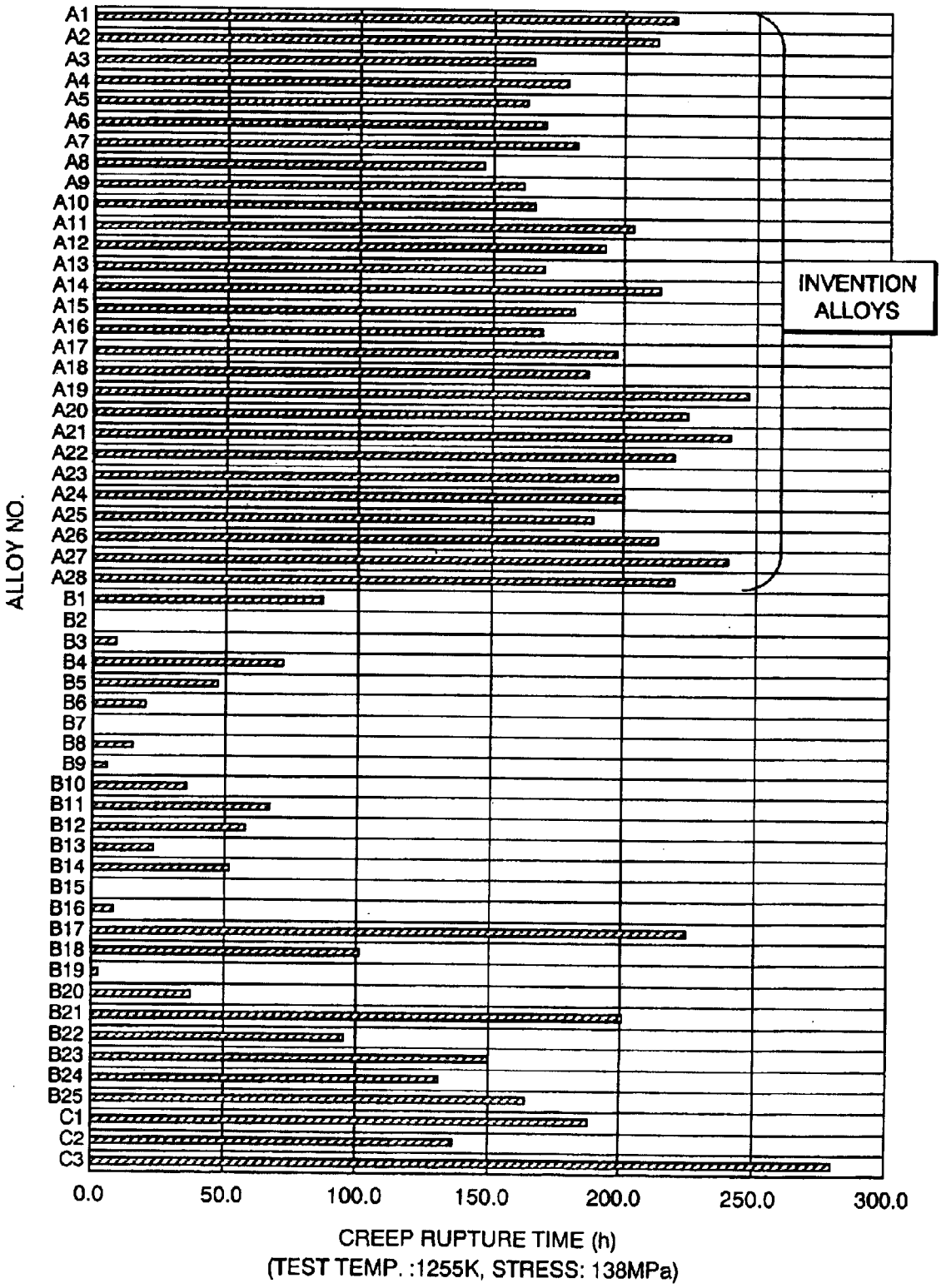
FIG. 3 is a bar graph showing creep rupture time in creep rupture tests.
Figure 4:
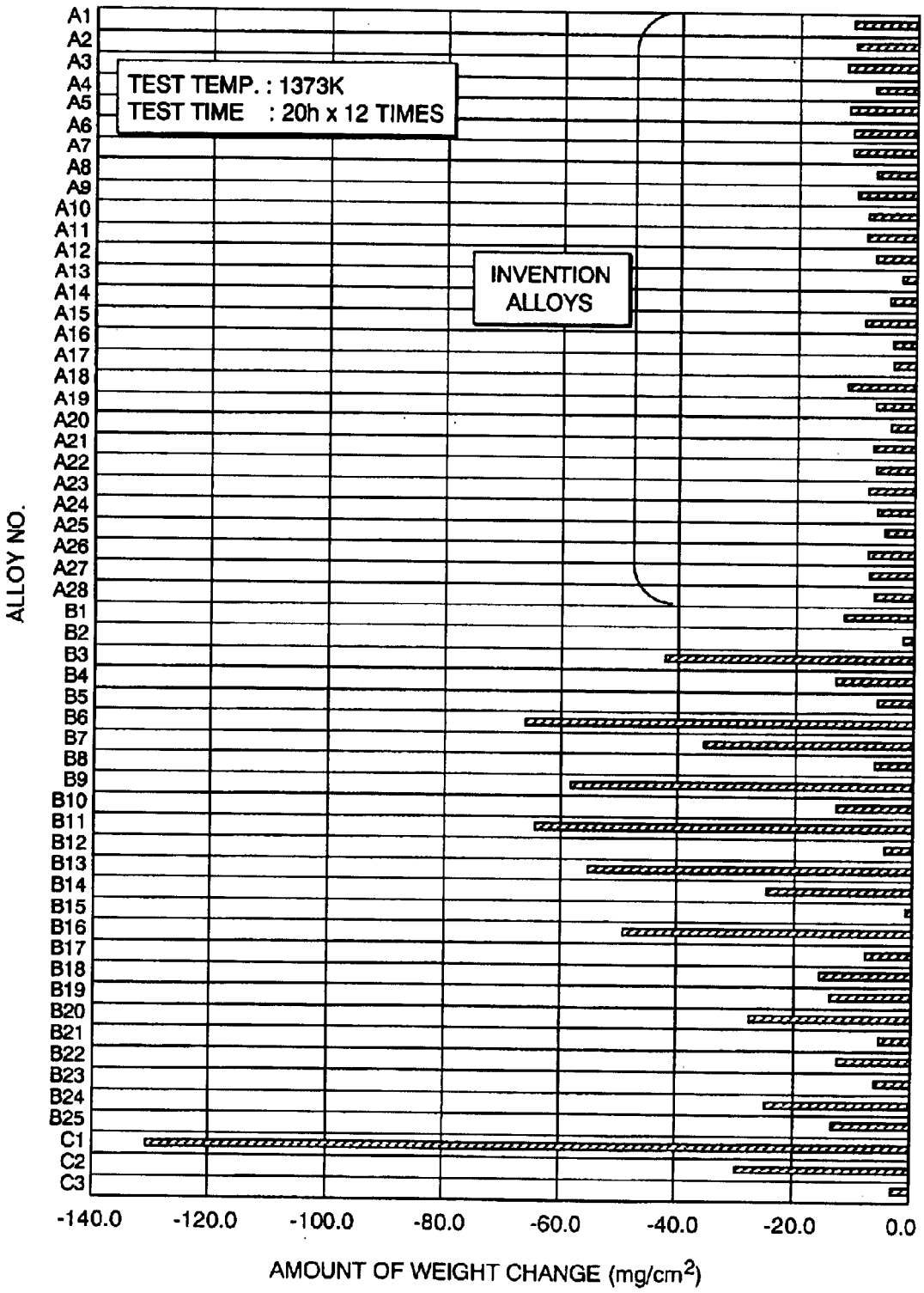
FIG. 4 is a bar graph showing oxidation loss in high temperature oxidation tests.
Figure 5:
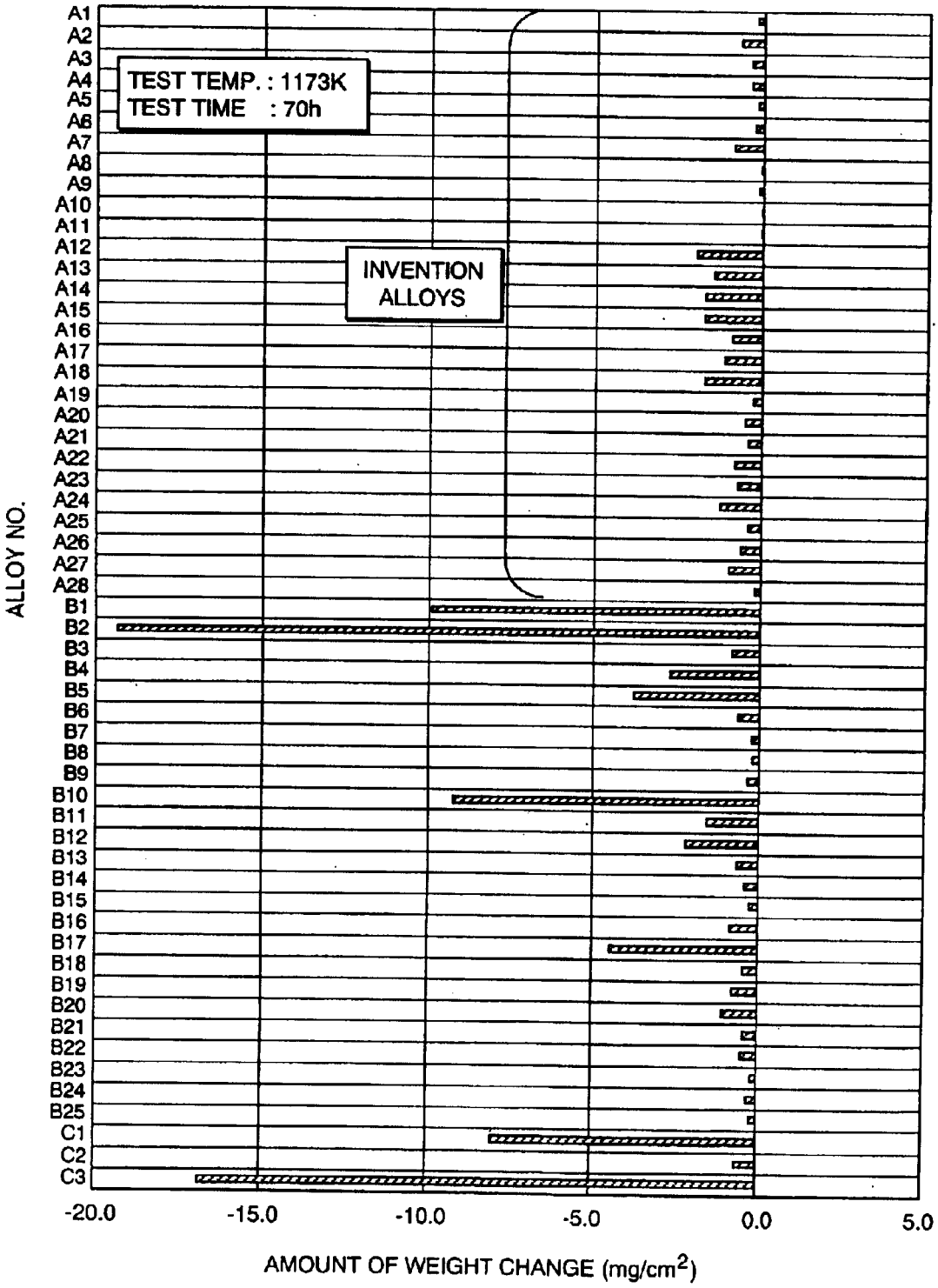
FIG. 5 is a bar graph showing corrosion loss in high temperature corrosion tests.

Table 6 and FIGS. 2 to 5 show test results of evaluation of properties of the alloys used in the experiments. Creep rupture test was conducted by measuring rupture time. Since there are relationship between creep rupture time and rupture strength, alloys having longer rupture time can be considered as alloys having higher rupture strength. FIG. 2 shows creep rupture time under the condition of 1123K-314 MPa. FIG. 3 creep rupture time under 1255K-138 MPa, FIG. 4 oxidation loss under high temperature oxidation and FIG. 5 corrosion loss under high temperature corrosion test, FIGS. 2 to 5 being all bar graphs.

TABLE 1-1

| Item | Alloy No. | Cr | Co | Ti | Al | Mo | W | Ta | Nb |
|---|---|---|---|---|---|---|---|---|---|
| Invention Alloys | A1 | 13.42 | 6.59 | 3.06 | 3.60 | 1.52 | 4.02 | 2.50 | 1.00 |
| | A2 | 14.07 | 7.99 | 3.09 | 4.22 | 1.98 | 4.23 | 2.99 | 1.47 |
| | A3 | 13.65 | 4.56 | 3.59 | 3.57 | 1.51 | 4.26 | 2.96 | 0.51 |
| | A4 | 14.23 | 7.10 | 3.44 | 4.21 | 2.03 | 3.77 | 2.83 | 1.21 |
| | A5 | 14.30 | 8.37 | 3.47 | 3.41 | 1.55 | 3.69 | 2.97 | 1.01 |
| | A6 | 13.66 | 4.44 | 3.38 | 3.54 | 1.98 | 3.97 | 3.20 | 1.50 |
| | A7 | 14.02 | 4.55 | 3.01 | 3.42 | 2.22 | 4.27 | 2.52 | 0.97 |
| | A8 | 14.17 | 8.45 | 3.03 | 3.94 | 1.54 | 3.98 | 3.21 | 0.53 |
| | A9 | 13.56 | 5.27 | 3.54 | 3.41 | 2.40 | 4.34 | 2.02 | 1.48 |
| | A10 | 13.96 | 8.04 | 3.56 | 3.60 | 2.20 | 3.72 | 2.47 | 0.52 |
| | A11 | 13.57 | 7.01 | 3.43 | 4.40 | 2.01 | 3.69 | 2.57 | 1.47 |
| | A12 | 14.50 | 6.37 | 3.09 | 4.42 | 1.79 | 4.10 | 2.70 | 1.23 |
| | A13 | 14.30 | 7.59 | 3.12 | 3.90 | 2.41 | 4.24 | 2.50 | 1.02 |
| | A14 | 13.76 | 7.95 | 3.49 | 3.86 | 1.99 | 4.28 | 3.11 | 1.18 |
| | A15 | 13.22 | 5.99 | 3.59 | 3.53 | 1.50 | 4.27 | 2.97 | 0.67 |
| | A16 | 14.29 | 6.55 | 3.63 | 3.81 | 2.22 | 4.10 | 2.69 | 1.01 |
| | A17 | 13.81 | 7.21 | 3.09 | 3.91 | 1.96 | 4.28 | 3.10 | 1.22 |
| | A18 | 13.43 | 6.01 | 3.27 | 3.58 | 1.53 | 3.97 | 2.53 | 1.02 |
| | A19 | 14.00 | 7.02 | 3.35 | 4.21 | 1.80 | 4.15 | 2.75 | 1.20 |
| | A20 | 14.00 | 7.97 | 3.35 | 3.96 | 2.00 | 4.30 | 2.97 | 1.03 |
| | A21 | 14.50 | 6.71 | 3.27 | 3.80 | 1.80 | 4.11 | 2.69 | 1.23 |
| | A22 | 13.67 | 7.94 | 3.45 | 4.40 | 1.97 | 4.26 | 3.12 | 1.20 |
| | A23 | 13.40 | 6.02 | 3.25 | 3.65 | 2.41 | 3.96 | 2.58 | 1.03 |
| | A24 | 14.06 | 7.00 | 3.36 | 4.22 | 1.82 | 4.16 | 2.77 | 1.18 |
| | A25 | 14.08 | 7.89 | 3.31 | 3.99 | 2.22 | 4.29 | 2.99 | 1.01 |
| | A26 | 14.49 | 6.74 | 3.25 | 4.41 | 1.83 | 4.12 | 2.71 | 1.22 |
| | A27 | 14.31 | 7.62 | 3.11 | 3.89 | 2.05 | 4.23 | 2.55 | 1.20 |
| | A28 | 14.03 | 7.95 | 3.36 | 3.97 | 2.00 | 4.29 | 2.96 | 1.02 |

TABLE 1-2

| Item | Alloy No. | Hf | Re | P | S | C | B | O | N | Ni |
|---|---|---|---|---|---|---|---|---|---|---|
| Invention alloys | A1 | 0.01 | 0.008 | 0.003 | 0.005 | 0.14 | 0.011 | 0.00 | 0.004 | 64.11 |
| | A2 | 0.04 | 0.007 | 0.003 | 0.004 | 0.12 | 0.017 | 0.002 | 0.002 | 60.00 |
| | A3 | 0.02 | 0.006 | 0.003 | 0.003 | 0.12 | 0.016 | 0.003 | 0.003 | 65.22 |
| | A4 | 0.09 | 0.008 | 0.004 | 0.005 | 0.13 | 0.019 | 0.002 | 0.004 | 63.74 |
| | A5 | 0.06 | 0.005 | 0.003 | 0.004 | 0.13 | 0.011 | 0.001 | 0.004 | 60.98 |
| | A6 | 0.01 | 0.005 | 0.003 | 0.003 | 0.13 | 0.013 | 0.001 | 0.003 | 64.76 |
| | A7 | 0.09 | 0.006 | 0.003 | 0.005 | 0.11 | 0.011 | 0.001 | 0.002 | 65.39 |
| | A8 | 0.01 | 0.007 | 0.003 | 0.003 | 0.08 | 0.016 | 0.003 | 0.004 | 62.22 |
| | A9 | 0.05 | 0.006 | 0.003 | 0.003 | 0.11 | 0.011 | 0.002 | 0.003 | 65.02 |
| | A10 | 0.00 | 0.007 | 0.003 | 0.003 | 0.08 | 0.017 | 0.002 | 0.004 | 61.97 |
| | A11 | 0.05 | 0.008 | 0.003 | 0.005 | 0.09 | 0.015 | 0.002 | 0.003 | 65.28 |
| | A12 | 0.09 | 0.010 | 0.004 | 0.005 | 0.11 | 0.014 | 0.002 | 0.003 | 61.81 |
| | A13 | 0.01 | 0.009 | 0.003 | 0.003 | 0.10 | 0.016 | 0.001 | 0.004 | 61.63 |
| | A14 | 0.07 | 0.008 | 0.003 | 0.004 | 0.11 | 0.010 | 0.003 | 0.003 | 60.30 |
| | A15 | 0.06 | 0.007 | 0.003 | 0.004 | 0.11 | 0.010 | 0.002 | 0.003 | 64.06 |
| | A16 | 0.05 | 0.006 | 0.004 | 0.003 | 0.10 | 0.019 | 0.002 | 0.004 | 61.72 |
| | A17 | 0.03 | 0.006 | 0.003 | 0.003 | 0.09 | 0.013 | 0.003 | 0.003 | 61.41 |
| | A18 | 0.01 | 0.010 | 0.004 | 0.004 | 0.11 | 0.015 | 0.002 | 0.003 | 64.50 |
| | A19 | 0.04 | 0.006 | 0.003 | 0.003 | 0.10 | 0.015 | 0.001 | 0.004 | 61.76 |
| | A20 | 0.08 | 0.007 | 0.003 | 0.004 | 0.10 | 0.015 | 0.002 | 0.003 | 60.21 |
| | A21 | 1.71 | 0.005 | 0.003 | 0.004 | 0.11 | 0.014 | 0.002 | 0.004 | 60.26 |
| | A22 | 1.76 | 0.006 | 0.004 | 0.003 | 0.11 | 0.010 | 0.002 | 0.004 | 58.76 |
| | A23 | 1.10 | 0.005 | 0.004 | 0.004 | 0.11 | 0.015 | 0.001 | 0.003 | 63.49 |
| | A24 | 1.43 | 0.008 | 0.004 | 0.003 | 0.10 | 0.015 | 0.002 | 0.004 | 60.24 |
| | A25 | 1.49 | 0.006 | 0.003 | 0.004 | 0.10 | 0.015 | 0.002 | 0.004 | 58.79 |
| | A26 | 0.10 | 0.402 | 0.004 | 0.005 | 0.11 | 0.014 | 0.004 | 0.003 | 61.38 |
| | A27 | 0.02 | 0.301 | 0.003 | 0.004 | 0.10 | 0.017 | 0.002 | 0.004 | 61.33 |
| | A28 | 0.09 | 0.203 | 0.004 | 0.005 | 0.10 | 0.015 | 0.002 | 0.003 | 60.00 |

TABLE 2-1

| Item | Alloy No. | Cr | Co | Ti | Al | Mo | W | Ta | Nb |
|---|---|---|---|---|---|---|---|---|---|
| Comparative alloys | B1 | 14.07 | 9.31 | 2.39 | 2.90 | 1.50 | 3.95 | 4.01 | 2.47 |
| | B2 | 14.62 | 8.93 | 2.44 | 3.89 | 2.45 | 4.46 | 5.02 | 3.52 |
| | B3 | 14.45 | 9.79 | 3.35 | 1.91 | 0.54 | 4.06 | 3.97 | 3.48 |
| | B4 | 14.68 | 8.60 | 3.51 | 3.00 | 1.50 | 4.53 | 5.01 | 1.48 |

TABLE 2-1-continued

| Item | Alloy No. | Cr | Co | Ti | Al | Mo | W | Ta | Nb |
|---|---|---|---|---|---|---|---|---|---|
| | B5 | 13.51 | 8.84 | 3.54 | 3.97 | 2.47 | 3.57 | 2.98 | 2.48 |
| | B6 | 14.22 | 8.91 | 4.58 | 2.07 | 1.50 | 3.50 | 4.95 | 2.51 |
| | B7 | 13.76 | 9.65 | 4.58 | 2.92 | 2.54 | 4.02 | 2.97 | 3.51 |
| | B8 | 14.55 | 9.56 | 4.64 | 4.05 | 0.46 | 4.50 | 3.99 | 1.52 |
| | B9 | 14.26 | 6.47 | 2.46 | 2.10 | 2.54 | 4.48 | 3.98 | 2.48 |
| | B10 | 13.21 | 5.27 | 2.44 | 3.11 | 0.46 | 3.45 | 4.96 | 3.47 |
| | B11 | 14.60 | 6.34 | 3.37 | 2.01 | 1.45 | 4.57 | 2.99 | 3.47 |
| | B12 | 14.11 | 5.82 | 3.43 | 4.00 | 0.50 | 3.95 | 4.96 | 2.51 |
| | B13 | 14.57 | 5.67 | 4.60 | 2.10 | 2.45 | 4.05 | 4.95 | 1.49 |
| | B14 | 13.28 | 6.51 | 4.41 | 2.89 | 0.49 | 4.51 | 3.04 | 2.49 |
| | B15 | 14.40 | 6.23 | 4.35 | 4.04 | 1.49 | 3.48 | 3.99 | 3.49 |
| | B16 | 14.41 | 8.90 | 2.39 | 2.00 | 0.52 | 3.46 | 2.95 | 1.49 |
| | B17 | 13.37 | 6.61 | 2.50 | 4.05 | 1.51 | 3.97 | 2.99 | 1.52 |
| | B18 | 13.91 | 5.37 | 3.59 | 3.06 | 2.51 | 3.47 | 2.95 | 1.49 |
| | B19 | 14.75 | 3.74 | 3.00 | 2.94 | 0.98 | 3.75 | 1.99 | 0.50 |
| | B20 | 13.27 | 7.82 | 3.53 | 2.92 | 0.98 | 3.93 | 2.48 | 1.47 |
| | B21 | 13.48 | 6.74 | 3.89 | 4.09 | 1.02 | 4.26 | 2.52 | 0.49 |
| | B22 | 14.22 | 5.93 | 2.90 | 3.47 | 0.99 | 3.72 | 3.03 | 1.47 |
| | B23 | 13.80 | 3.96 | 3.44 | 3.90 | 1.01 | 3.94 | 3.03 | 0.99 |
| | B24 | 13.42 | 6.69 | 3.89 | 3.07 | 1.98 | 3.95 | 3.00 | 0.49 |
| | B25 | 13.83 | 8.36 | 3.89 | 3.42 | 0.95 | 4.34 | 1.99 | 0.99 |
| Conv. | C1 | 14.07 | 9.20 | 5.03 | 3.03 | 3.96 | 3.92 | 0.00 | 0.00 |
| alloys | C2 | 14.18 | 10.11 | 4.76 | 2.95 | 1.50 | 3.84 | 2.79 | 0.00 |
| | C3 | 13.24 | 10.10 | 2.67 | 4.02 | 1.52 | 4.33 | 4.74 | 0.00 |

TABLE 2-2

| Item | Alloy No. | Hf | Re | P | S | C | B | O | N | Ni |
|---|---|---|---|---|---|---|---|---|---|---|
| Comparative | B1 | 0.01 | 0.008 | 0.004 | 0.004 | 0.10 | 0.019 | 0.002 | 0.002 | 59.25 |
| alloys | B2 | 0.05 | 0.006 | 0.003 | 0.005 | 0.13 | 0.013 | 0.001 | 0.003 | 54.46 |
| | B3 | 0.03 | 0.010 | 0.003 | 0.003 | 0.14 | 0.013 | 0.002 | 0.003 | 58.25 |
| | B4 | 0.05 | 0.005 | 0.003 | 0.005 | 0.08 | 0.017 | 0.001 | 0.002 | 57.52 |
| | B5 | 0.03 | 0.005 | 0.004 | 0.005 | 0.09 | 0.019 | 0.002 | 0.004 | 58.48 |
| | B6 | 0.02 | 0.008 | 0.003 | 0.003 | 0.13 | 0.011 | 0.003 | 0.002 | 57.58 |
| | B7 | 0.04 | 0.008 | 0.004 | 0.005 | 0.05 | 0.016 | 0.002 | 0.002 | 55.92 |
| | B8 | 0.07 | 0.008 | 0.003 | 0.003 | 0.11 | 0.018 | 0.003 | 0.002 | 56.51 |
| | B9 | 0.07 | 0.006 | 0.004 | 0.004 | 0.08 | 0.014 | 0.002 | 0.004 | 61.05 |
| | B10 | 0.05 | 0.009 | 0.003 | 0.004 | 0.10 | 0.012 | 0.002 | 0.002 | 63.45 |
| | B11 | 0.04 | 0.009 | 0.004 | 0.004 | 0.09 | 0.015 | 0.001 | 0.004 | 61.03 |
| | B12 | 0.01 | 0.009 | 0.004 | 0.003 | 0.06 | 0.014 | 0.002 | 0.002 | 60.62 |
| | B13 | 0.08 | 0.007 | 0.004 | 0.005 | 0.10 | 0.017 | 0.002 | 0.004 | 59.90 |
| | B14 | 0.06 | 0.005 | 0.003 | 0.003 | 0.13 | 0.010 | 0.003 | 0.002 | 62.16 |
| | B15 | 0.08 | 0.007 | 0.004 | 0.003 | 0.06 | 0.016 | 0.002 | 0.003 | 58.36 |
| | B16 | 0.07 | 0.008 | 0.003 | 0.003 | 0.08 | 0.013 | 0.002 | 0.004 | 63.70 |
| | B17 | 0.00 | 0.006 | 0.004 | 0.005 | 0.12 | 0.011 | 0.003 | 0.004 | 63.39 |
| | B18 | 0.05 | 0.010 | 0.004 | 0.004 | 0.14 | 0.014 | 0.002 | 0.003 | 62.42 |
| | B19 | 0.01 | 0.005 | 0.004 | 0.005 | 0.15 | 0.013 | 0.001 | 0.004 | 68.16 |
| | B20 | 0.09 | 0.006 | 0.003 | 0.004 | 0.12 | 0.010 | 0.002 | 0.004 | 63.36 |
| | B21 | 0.00 | 0.005 | 0.003 | 0.005 | 0.13 | 0.019 | 0.002 | 0.002 | 63.34 |
| | B22 | 0.05 | 0.006 | 0.003 | 0.005 | 0.11 | 0.011 | 0.002 | 0.004 | 64.08 |
| | B23 | 0.08 | 0.008 | 0.003 | 0.003 | 0.09 | 0.016 | 0.001 | 0.004 | 65.73 |
| | B24 | 0.05 | 0.009 | 0.003 | 0.004 | 0.09 | 0.012 | 0.002 | 0.003 | 63.24 |
| | B25 | 0.06 | 0.008 | 0.003 | 0.004 | 0.10 | 0.013 | 0.002 | 0.004 | 62.04 |
| Conv. | C1 | 0.00 | 0.006 | 0.004 | 0.005 | 0.12 | 0.015 | 0.001 | 0.003 | 60.64 |
| alloys | C2 | 0.09 | 0.008 | 0.004 | 0.004 | 0.08 | 0.010 | 0.001 | 0.002 | 59.67 |
| | C3 | 0.01 | 0.007 | 0.004 | 0.005 | 0.10 | 0.015 | 0.002 | 0.003 | 59.23 |

TABLE 3

| Kinds of alloy | No. | Solid solution Heat Treatment Condition | Aging condition First aging | Second aging | Third aging |
|---|---|---|---|---|---|
| Invention alloys | A1~A28 | 1480K/2h, AC | 1366K/4h, AC | 1325K/4h, AC | 1116K/16h, AC |
| Compara. alloys | B1~B25 | 1480K/2h, AC | 1366K/4H, AC | 1325K/4h, AC | 1116K/16h, AC |
| Convent. alloys | C1 AC | 1480K/2h, AC | 1366K/4h, | 1325K/4h, AC | 1116K/16h, AC |
| | C2 | 1395K/2h | 1116K/24h, AC | — | — |
| | C3 | 1433K/2h | 1116K/24h, AC | — | — |

TABLE 4

| Evaluation tests | Contents of tests |
|---|---|
| Creep rupture test | Test temperature and stress<br>(1) 1123K-314MPa<br>(2) 1255K-138MPa |
| Oxidation test | Repeating Oxidations in atmosphere<br>(1) 1373K-24h (20h × 12 times) |
| Corrosion resistance test | Corrosion test in high temperature gas<br>(1) 1173K-70h (7h × 10 times)<br>Fuel: Light Oil,<br>NaCl amount; 80 ppm |

TABLE 5-1

| Item | Alloy No. | Stability of structure | TiEq | MoEq |
|---|---|---|---|---|
| Invention alloys | A1 | ○ | 4.24 | 5.98 |
| | A2 | ○ | 4.64 | 7.29 |
| | A3 | ○ | 4.64 | 5.83 |
| | A4 | ○ | 4.81 | 6.75 |
| | A5 | ○ | 4.78 | 6.09 |
| | A6 | ○ | 5.00 | 7.30 |
| | A7 | ○ | 4.18 | 6.79 |
| | A8 | ○ | 4.15 | 5.87 |
| | A9 | ○ | 4.84 | 7.26 |
| | A10 | ○ | 4.48 | 5.99 |
| | A11 | ○ | 4.87 | 6.82 |
| | A12 | ○ | 4.44 | 6.63 |
| | A13 | ○ | 4.31 | 7.00 |
| | A14 | ○ | 4.92 | 7.09 |
| | A15 | ○ | 4.72 | 5.99 |
| | A16 | ○ | 4.86 | 6.83 |
| | A17 | ○ | 4.54 | 7.10 |
| | A18 | ○ | 4.47 | 6.00 |
| | A19 | ○ | 4.70 | 6.66 |
| | A20 | ○ | 4.67 | 6.88 |
| | A21 | ○ | 4.62 | 6.64 |
| | A22 | ○ | 4.89 | 7.09 |
| | A23 | ○ | 4.46 | 6.91 |
| | A24 | ○ | 4.70 | 6.68 |
| | A25 | ○ | 4.62 | 7.09 |
| | A26 | ○ | 4.60 | 6.68 |
| | A27 | ○ | 4.40 | 6.85 |
| | A28 | ○ | 4.67 | 6.86 |

TABLE 5-2

| Item | Alloy No. | Stability of structure | TiEq | MoEq |
|---|---|---|---|---|
| Compara. Alloys | B1 | ● | 4.72 | 8.24 |
| | B2 | ● | 5.58 | 11.07 |
| | B3 | ● | 6.19 | 8.36 |
| | B4 | | 5.60 | 8.06 |
| | B5 | | 5.61 | 8.47 |
| | B6 | ● | 7.18 | 8.54 |
| | B7 | ● | 7.17 | 9.84 |
| | B8 | ● | 6.84 | 6.49 |
| | B9 | ● | 4.79 | 9.55 |
| | B10 | ● | 5.54 | 8.47 |
| | B11 | ● | 5.95 | 9.00 |
| | B12 | ● | 5.04 | 7.76 |
| | B13 | ● | 6.68 | 8.73 |
| | B14 | ● | 6.50 | 7.03 |
| | B15 | ● | 7.20 | 9.03 |
| | B16 | ○ | 3.94 | 5.43 |
| | B17 | ○ | 4.07 | 6.74 |
| | B18 | ○ | 5.40 | 7.95 |
| | B19 | ○ | 3.78 | 4.51 |
| | B20 | ○ | 4.94 | 5.86 |
| | B21 | ○ | 4.81 | 5.08 |
| | B22 | ○ | 4.46 | 6.08 |
| | B23 | ○ | 4.75 | 5.69 |
| | B24 | ○ | 5.04 | 6.14 |
| | B25 | ○ | 4.93 | 5.28 |
| Conven. alloys | C1 | ○ | 5.03 | 6.01 |
| | C2 | ○ | 5.50 | 4.98 |
| | C3 | ○ | 3.92 | 6.29 |

TABLE 6-1

| Item | Alloy No. | Creep rupture time (h) 1123K-314MPa | 1255K-138MPa | Oxidation amount ($mg/cm^2$) | Corrosion Amount ($mg/cm^2$) |
|---|---|---|---|---|---|
| Invention alloys | A1 | 386.0 | 220.7 | −11.26 | −0.17 |
| | A2 | 362.5 | 212.9 | −10.46 | −0.63 |
| | A3 | 322.7 | 165.6 | −11.79 | −0.33 |
| | A4 | 358.1 | 179.4 | −7.24 | −0.33 |
| | A5 | 395.7 | 163.2 | −11.54 | −0.12 |
| | A6 | 375.6 | 170.6 | −10.78 | −0.26 |
| | A7 | 348.8 | 181.8 | −10.82 | −0.83 |
| | A8 | 358.5 | 146.0 | −7.17 | 0.03 |
| | A9 | 333.5 | 161.8 | −10.43 | −0.09 |
| | A10 | 371.6 | 165.8 | −8.48 | 0.03 |
| | A11 | 457.1 | 203.7 | −8.68 | −0.04 |
| | A12 | 430.2 | 192.7 | −7.24 | −1.93 |
| | A13 | 377.3 | 169.9 | −2.55 | −1.43 |
| | A14 | 389.8 | 214.9 | −4.76 | −1.64 |
| | A15 | 364.2 | 181.4 | −8.78 | −1.68 |
| | A16 | 328.2 | 170.2 | −4.28 | −0.83 |
| | A17 | 327.5 | 198.5 | −4.17 | −1.05 |
| | A18 | 376.4 | 187.1 | −11.79 | −1.62 |
| | A19 | 425.3 | 247.4 | −6.88 | −0.22 |
| | A20 | 537.5 | 225.0 | −4.40 | −0.43 |
| | A21 | 440.2 | 240.3 | −7.22 | −0.33 |
| | A22 | 420.3 | 220.1 | −6.84 | −0.74 |
| | A23 | 410.3 | 198.1 | −8.10 | −0.62 |
| | A24 | 397.5 | 200.4 | −6.55 | −1.20 |
| | A25 | 413.3 | 188.4 | −5.44 | −0.31 |
| | A26 | 486.7 | 213.6 | −8.11 | −0.56 |
| | A27 | 510.4 | 240.3 | −7.84 | −0.89 |
| | A28 | 470.1 | 220.1 | −7.12 | −0.11 |

TABLE 6-2

| Item | Alloy No. | Creep Rupture Time (h) 1123K-314MPa | Creep Rupture Time (h) 1255K-138MPa | Oxidation amount (mg/cm$^2$) | Corrosion amount (mg/cm$^2$) |
|---|---|---|---|---|---|
| Comparative alloys | B1 | 432.7 | 85.7 | −11.98 | −9.91 |
| | B2 | 0.0 | 0.0 | −2.02 | −19.38 |
| | B3 | 17.2 | 7.4 | −42.35 | −0.79 |
| | B4 | 375.3 | 71.5 | −13.18 | −2.66 |
| | B5 | 67.4 | 47.0 | −6.36 | −3.77 |
| | B6 | 22.2 | 19.5 | −66.07 | −0.58 |
| | B7 | 0.0 | 0.0 | −35.40 | −0.18 |
| | B8 | 42.8 | 15.2 | −6.83 | −0.18 |
| | B9 | 11.7 | 5.3 | −58.18 | −0.31 |
| | B10 | 109.3 | 35.8 | −13.12 | −9.17 |
| | B11 | 12.8 | 67.1 | −64.17 | −1.52 |
| | B12 | 130.4 | 57.7 | −4.84 | −2.15 |
| | B13 | 18.2 | 22.8 | −55.06 | −0.62 |
| | B14 | 74.4 | 51.8 | −24.63 | −0.38 |
| | B15 | 0.0 | 0.0 | −1.26 | −0.24 |
| | B16 | 35.8 | 8.0 | −49.22 | −0.79 |
| | B17 | 281.0 | 224.6 | −8.38 | −4.46 |
| | B18 | 334.6 | 100.7 | −15.87 | −0.39 |
| | B19 | 22.4 | 2.3 | −14.10 | −0.72 |
| | B20 | 92.4 | 36.4 | −27.34 | −1.04 |
| | B21 | 281.8 | 201.5 | −5.74 | −0.41 |
| | B22 | 242.1 | 95.9 | −12.73 | −0.45 |
| | B23 | 177.9 | 150.2 | −6.53 | −0.13 |
| | B24 | 270.4 | 131.6 | −24.51 | −0.25 |
| | B25 | 294.2 | 165.2 | −13.42 | −0.17 |
| Conv. alloys | C1 | 387.6 | 188.3 | −130.94 | −7.90 |
| | C2 | 159.4 | 136.3 | −29.49 | −0.57 |
| | C3 | 530.4 | 280.3 | −3.20 | −16.80 |

As is apparent from Table 6, though alloys A1 to A28 of the present invention exhibit almost the same rupture time and rupture strength as those of a conventional alloy (corresponding to U.S. Pat. No. 3,615,376), creep rupture time, oxidation loss and corrosion loss of the alloy of the present invention are greatly reduced and oxidation resistance is greatly improved. When compared with another conventional alloy (corresponding to U.S. Pat. No. 6,416,596B1), creep rupture time is almost two times that of the conventional alloy, whilst oxidation loss and corrosion loss are almost the same as those of conventional alloy. When compared with another conventional alloy (corresponding to U.S. Pat. No. 5,431,750), though the alloy of the present invention is a little bit worse in creep rupture time than the conventional one, oxidation resistance time is almost the same as that of the conventional one, and corrosion loss is greatly reduced and corrosion resistance is greatly improved.

According to the present inventions there are provided superior alloys that, without sacrificing high temperature, creep rupture time of the alloy have greatly improved oxidation resistance and oxidation resistance properties at high temperatures and have well balanced creep rupture strength, oxidation resistance properties and corrosion resistance.

The comparative alloys that do not satisfy the alloy compositions of the present invention are inferior in one or more of creep rupture strength, oxidation resistance properties, or oxidation resistance.

In the above examples, although the description was made with respect to conventional casting alloys, the alloy compositions can be applied to unidirectional casings. The alloys of the present invention containing C and B that are effective for reinforcing grain boundaries and Hf that is an effective for suppressing cracks of grain boundaries at the time of coating, and hence the alloys are suitable for unidirectional castings.

As having been described, the present invention provides nickel based superalloys that have high temperature creep strength, corrosion resistance and oxidation resistance and are capable of normal casting. Therefore, the alloys are suitable for land-based gas turbines.

What is claimed is:

1. A high-strength Ni-base superalloy comprising:

12.0 to 16.0% by weight of Cr, 4.0 to 9.0% by weight of Co, 3.4 to 4.6% by weight of Al, 0.5 to 1.6% by weight of Nb, 0.05 to 0.16%b by weight of C, 0.005 to 0.025% by weight of B, 0 to 2.0% by weight of Hf, 0 to 0.5% by weight of Re, 0 to 0.05% by weight of Zr, 0 to 0.005% by weight of 0, 0 to 0.005% by weight of N, 0 to 0.01% by weight of Si, 0 to 0.2% by weight of Mn, 0 to 0.01% by weight of P, 0 to 0.01% by weight of S, and at least one of Ti, Ta and Mo, wherein Ti, Ta and Mo are in such amounts that are calculated by equations, wherein TiEq is within a range of from 4.0 to 6.0, and MoEq is within a range of from 5.0 to 8.0, and wherein γ' phase is precipitated in the matrix of the alloy, TiEq=Ti % by weight+0.5153×Nb % by weight+0.2647×[Ta] % by weight, and MoEq=Mo % by weight+0.5217×W+0.5303×Ta % by weight+1.0326×Nb % by weight.

2. The Ni-base superalloy according to claim 1, wherein TiEq is within a range of from 4.0 to 5.0, and MoEq is within a range of from 5.5 to 7.5.

3. The Ni-base superalloy according to claim 1, wherein an amount of W is 3.5 to 4.5% by weight.

4. The Ni-base superalloy according to claim 1, wherein an amount of Ti is 3.0 to 4.0% by weight.

5. The Ni-base superalloy according to claim 1, wherein an amount of Mo is 1.5 to 2.5% by weight.

6. The Ni-base superalloy according to claim 1, wherein an amount of Ta is 2.0 to 3.4% by weight.

7. The Ni-base superalloy according to claim 1, wherein an amount of W is 3.5% by weight, Ti is 1.5 to 2.5%, and Ta is 2.0 to 3.4%.

8. The Ni-base alloy according to claim 1, wherein the γ' phase is precipitated in an austenite matrix.

9. The Ni-base superalloy according to claim 1, wherein the alloy comprises:

13.0 to 15.0% by weight of Cr, 6.0 to 8.0% by weight of Co, 3.8 to 4.4% by weight of Mo, 2.5 to 3.2% by weight of Ta, 3.6 to 4.4% by weight of Al, 1.0 to 1.5% by weight of Nb, 0.10 to 0.16% by weight of C, and 0.01 to 0.02% by weight of B.

10. A high-strength Ni-base superalloy comprising:

12.0 to 16.0% by weight of Cr, 4.0 to 9.0% by weight of Co, 3.4 to 4.6% by weight of Al, 0.5 to 1.6% by weight of Nb, 0.05 to 0.16% by weight of C, 0.005 to 0.025% by weight of B, 0 to 2.0% by weight of Hf, 0 to 0.5% by weight of Re, 0 to 0.05% by weight of Zr, 0 to 0.005% by weight of 0, 0 to 0.005% by weight of N, 0 to 0.01% by weight of Si, 0 to 0.2% by weight of Mn, 0 to 0.01% by weight of P, 0 to 0.01% by weight of S, and at least one of Ti, Ta, Mo, wherein Ti, Ta and Mo are in such amounts that are calculated by the equations, wherein TiEq is within a range of from 4.0 to 6.0, and MoEq is within a range of from 5.0 to 8.0, and wherein γ' phase is precipitated in the matrix of the alloy, TiEq=Ti % by weight+0.5153×Nb % by weight+0.2647×Ta % by weight, and MoEq=Mo % by weight+0.5217×W% by weight+0.5303×Ta % by weight+1.0326×Nb % by weight, the alloy being an ordinary casting or a unidirectional casting.

11. The Ni-base superalloy according to claim 10, wherein Hf is within a range of from 0 to 0.1% by weight.

12. The Ni-base superalloy according to claim 10, wherein Hf is within a range of 0.7 to 2.0% by weight.

13. The Ni-base superalloy according to claim 10, wherein an amount of W is within a range of from 3.5 to 4.5% by weight, an amount of Ti is within a range of from 3.0 to 4.0% by weight, an amount of Mo is within a range of from 1.5 to 2.5% by weight, and an amount of Ta is within a range of from 2.0 to 3.4% by weight.

14. The Ni-base alloy according to claim 10, wherein an amount of Cr is within a range of from 13.0 to 15.0% by weight, an amount of Co is within a range of from 6.0 to 8.0% by weight, an amount of W is within a range of from 3.8 to 4.4% by weight, an amount of Mo is within a range of from 1.6 to 2.3% by weight, an amount of Ta is within a range of from 2.5 to 3.6% by weight, an amount of Ti is within a range of from 3.2 to 3.6% by weight, an amount of Al is within arrange of from 3.6 to 4.4% by weight, an amount of Nb is within a range of from 1.0 to 1.5% by weight, and an amount of C is within a range of from 0.01 to 0.02% by weight.

15. A gas turbine blade made of a Ni-base superalloy, the alloy comprising:

12.0 to 16.0% by weight of Cr, 15 4.0 to 9.0% by weight of Co, 3.4 to 4.6% by weight of Al, 0.5 to 1.6% by weight of Nb, 0.05 to 0.16%b by weight of C, 0.005 to 0.025% by weight of B, 0 to 2.0% by weight of Hf, 0 to 0.5% by weight of Re, 0 to 0.05% by weight of Zr, 0 to 0.005% by weight of 0, 0 to 0.005% by weight of N, 0 to 0.01% by weight of Si, 0 to 0.2% by weight of Mn, 0 to 0.01% by weight of P, 0 to 0.01% by weight of S, and at least one of Ti, Ta, Mo, wherein Ti, Ta and Mo are in such amounts that are calculated by the equations, wherein TiEq is within a range of from 4.0 to 6.0, and MoEq is within a range of from 5.0 to 8.0, and wherein γ' phase is precipitated in the matrix of the alloy, TiEq=Ti % by weight+0.5153×Nb % by weight+0.2647×Ta % by weight, and MoEq=Mo % by weight+0.5217×W % by weight+0.5303×Ta % by weight+1.0326×Nb % by weight.

16. The gas turbine blade according to claim 15, wherein an amount of W is within a range of from 3.5 to 4.5% by weight, an amount of Ti is within a range of from 3.0 to 4.0% by weight, an amount of Mo is within a range of from 1.5 to 2.5% by weight, and an amount of Ta is within arrange of from 2.0 to 3.4% by weight.

17. The gas turbine blade according to claim 15, wherein an amount of Cr is within a range of from an amount of Cr is within a range of from 13.0 to 15.0% by weight, an amount of Co is within a range of from 6.0 to 8.0% by weight, an amount of W is within a range of from 3.8% to 4.4% by weight, an amount of Mo is within a range of from 1.6 to 2.3% by weight, an amount of Ta is within a range of from 2.5 to 3.2% by weight, an amount of Al is within a range of from 3.6 to 4.4% by weight, an amount of Nb is within a range of from 1.0 to 1.5% by weight, an amount of C is within a range of from 0.1 to 0.16% by weight, and an amount of B is within a range of from 0.01 to 0.02% by weight.

* * * * *